US007249693B2

(12) United States Patent
Buxmann

(10) Patent No.: US 7,249,693 B2
(45) Date of Patent: Jul. 31, 2007

(54) FLUID DISPENSER

(75) Inventor: Detmar Buxmann, Saarbrucken (DE)

(73) Assignee: Ursapharm Arzneimittel GmbH & Co. KG, Saarbrücken (DE)

( * ) Notice: Subject to any disclaimer, the term of this patent is extended or adjusted under 35 U.S.C. 154(b) by 256 days.

(21) Appl. No.: 11/019,861

(22) Filed: Dec. 22, 2004

(65) Prior Publication Data

US 2005/0173459 A1 Aug. 11, 2005

Related U.S. Application Data

(63) Continuation-in-part of application No. 10/413,952, filed on Apr. 15, 2003, now abandoned.

(30) Foreign Application Priority Data

Apr. 9, 2003 (EP) ..... 03008290

(51) Int. Cl.
*B67D 5/58* (2006.01)

(52) U.S. Cl. ..... 222/189.11; 222/321.36

(58) Field of Classification Search ..... 222/321.6, 222/189.11

See application file for complete search history.

(56) References Cited

U.S. PATENT DOCUMENTS

| | | | |
|---|---|---|---|
| 5,232,687 | A | 8/1993 | Geimer |
| 5,614,172 | A | 3/1997 | Geimer |
| 6,053,368 | A | 4/2000 | Geimer |
| 6,095,376 | A | 8/2000 | Hennemann et al. |
| 6,234,365 | B1 | 5/2001 | Bougamont et al. |

*Primary Examiner*—Philippe Derakshani
(74) *Attorney, Agent, or Firm*—Scully, Scott, Murphy & Presser, P.C.

(57) ABSTRACT

A fluid dispenser for germ-free fluid is described incorporating at least one material being capable of interacting via an oligodynamically active substance. The dispenser includes a metering pump and inlet and outlet valves. The fluid coming into contact with at least one oligodynamically active substance is present in the region of the outlet valve, of the inlet thereto and/or the outlet therefrom.

21 Claims, 1 Drawing Sheet

FLUID DISPENSER

CROSS REFERENCE TO RELATED APPLICATION

The present application is a continuation-in-part of copending application Ser. No. 10/413,952, dated Apr. 15, 2003 now abandoned.

TECHNICAL FIELD OF THE INVENTION

The invention relates to a fluid dispenser for germ-free fluids.

DESCRIPTION OF RELATED ART

In the Pharmazeutische Zeitung, 124, No. 20, of May 17, 1979, on pages 949 and 950, a fluid dispenser is described that has the form of a dropping pipette and is attached to a container containing eye-drops. Inside the dropping pipette a silver deposit consisting of a layer of silver or a difficultly-soluble silver salt is disposed so that airborne germs drawn in with the drops that run back into the container have to pass an antimicrobial (oligodynamical) active silver layer before they enter the container. It is also stated that ceramic rings with silver chloride embedded and having a diameter of 9 mm have been found to be suitable. These ceramic rings can be firmly installed in the droppers of all the usual kinds of pharmaceuticals, eye-dropper bottles simply by pushing them in. This method of introducing the silver deposit into the droppers has the disadvantage that only the drops running back along the walls of the dropper come into contact with the silver deposit, but not the portions of the liquid in the interior of the column of fluid which flows back into the container from the dropper after use in the usual way with the dropper facing downwards. Each use of the eye-drop container thus leads to contamination of the eye-drops. A further disadvantage is that the interior of the container is in contact with the ambient air through the dropper, so that even while it is not being used germs constantly find their way in and lead to contamination of the eye-drops in the container.

From DE 40 27 320 C2 a fluid dispenser for germ-free fluid is known which comprises a through passage connecting an inlet opening for fluid and a delivery opening for said fluid and having therein an oligodynamically antimicrobial active substance. The device includes a metering pump and inlet and outlet valves. The oligodynamical germicidal active substance is present in the region of the inlet valve and/or the outlet valve. According to FIG. 1 of this document the springs are shown which can be coated with silver. Likewise, the valve ball functioning as the inlet valve consists of corundum having embedded therein a silver material as an oligodynamically effective substance. A disadvantage of this device is that often compatability problems occur due to the presence of silver and oxidation processes which produce undesired by-products, which often results in a limited choice of appropriate formulation.

SUMMARY OF THE INVENTION

One aspect of the present invention provides a fluid dispenser of the kind as referred to in DE 40 27 320 C2 which does not cause compatibility problems and prevents the formation of by-products while simultaneously an adequate and comparable microbiological safety (i.e. germ-free application) of the system is maintained.

The present invention relates to a fluid dispenser for germ-free fluid comprising a through passage connecting an inlet opening for fluid contained in a supply container made of flexible material and a delivery opening for dispensing said fluid and having therein at least one oligodynamically active substance that is in contact with the fluid; a metering pump operating without air pressure compensation, whereby no pressure compensation takes place in the container through the inflow of air during the operation of said metering pump, said pump having a spring means being in contact with the fluid, an inlet valve for closing said inlet opening, and an outlet valve; and an outlet passage being part of said through passage leading from said outlet valve to the delivery opening, wherein a decontamination means is provided in the upper part of said outlet passage said decontamination means comprising a material capable of interacting with germs via an oligodynamical substance selected from the group consisting of silver, silver salts, other silver compounds, alloys and nanomers thereof in either metallic or salt form or as a chemical compound thereof.

The present invention relates further to the use of the fluid dispenser of the invention. The fluid dispenser of the present invention is suitable for dispensing minute amounts of a liquid in various fields such as pharmaceutics, cosmetics and medical devices. The liquids are usually topically applied. Preferred liquids are ophthalmic and nasal compositions.

The term "interacting" should be defined in the context of the present invention as a type of a surface reaction. The theory is that the interaction takes place close to or preferably on the surface of the material capable of interacting with the germs contained in the liquid. The germs may hereby derive from a contamination of the unprotected outer part of the delivery opening that comes in contact with the environment. The germs hereby may be contained in the fluid, or in other substances coming into contact with the fluid dispenser, such as air, lachrymal liquor, mucosa or the like. One possible mechanism could be that the contaminated liquid comes into contact with ions derived from metal oxides which has been formed directly on the surface of the material. This contact results in an antimicrobial effect. A general rule can be seen in the relationship of the material surface and its size: the larger the surface is, the better the decontamination effect is. Different levels of interaction with the germs are hereby possible. For example, the interaction could result in a slowing down or stopping of the growth of the germs in the fluid. A strong level of interaction is e. g. the oligodynamic effect in which an oligodynamically active substance actually kills germs in the fluid.

According to the fluid dispenser of the invention, the decontamination means is provided in the outlet passage and preferably in the upper part of the outlet passage. The term "upper part" comprises the region of the outlet passage where still an optimum decontamination can be ensured.

According to the invention, a particularly intensive germicidal action results from the position of the outlet valve and the decontamination means. Due to the specific technical construction the moveable outlet valve does not come into direct contact with the environment, which results in a reduction of the risk of a contamination during the movement of the outlet valve. As a results an oligodynamically active substance has to be provided on the outside of the outlet valve, which is realised by the decontamination means. Further, with this construction the fluid in the container does not come constantly into contact with the oligodynamically active substances, which reduces the above mentioned unwanted reactions of the fluid with the oligodynamically substance. The metering pump operates without air pressure compensation, so that contamination of the fluid supply through the air flows into the container to effect the pressure compensation in the operation of conventional metering pumps is prevented. The fluid dispenser of the invention ensures that the fluid in the supply container is kept germ-free even during use, so that it is not necessary either to add preservatives or to introduce the oligodynamically active substance in other regions of the container.

The oligodynamically active substance is located at or near to the outlet passage to prevent microbiological contamination by reducing count of potential arising germs from the environment.

The materials and elements of the metering pump and the container which are in contact with the fluid could be any kind of elements and materials which are compatible with the respective fluid. In some applications, it is not necessary to provide any material capable of interacting with germs inside the metering pump and the container. However, in other applications it might be advantageous to use materials capable of interacting with germs within the metering pump and the container. For example, it might be advantageous if the inlet valve and/or the spring means comprise a material capable of interacting with germs. Hereby, the material could be selected from the group consisting of silver, silver salts, other silver compounds, stainless steel and nanomers thereof in either metallic or salt form or as a chemical compound thereof. In this case, the stainless steel could contain at least one element selected from the group consisting of chromium, nickel, molybdenium, copper, tungsten, aluminium, titanium, niob and tantal, the remainder being iron as the main component. Among the above materials, all materials comprising silver, silver salts or other silver compounds usually are oligodynamically active. Stainless steel materials are believed to be usually not oligodynamically active or, if they are, only to a very small extend. However, the stainless steel materials are believed to be able to interact with the germs by slowing down or stopping their growth.

Advantageously, said through passage is constantly filled, at least in the region of said inlet valve with said fluid. Further advantageously, the oligodynamically active substance is provided on the inner side of a cap that can be fitted onto said fluid dispenser to cover said delivery opening. Hereby, the cap may be provided with a pin and a hole. Further, the pin may fit in the delivery opening located in the head.

Further advantageously, said inner valve further includes a valve seat cooperating with the closure member wherein said valve seat is provided with said oligodynamically active substance. Further advantageously, the outlet valve further includes a valve seat cooperating with the closure member. Further advantageously, the inlet valve is a ball valve and a valve housing cooperating with a closure member of the inlet valve is provided, said valve housing being provided with said oligodynamically active substance. Advantageously, the outlet valve is a piston valve and a valve housing cooperating with a closure member of said outlet valve. Further advantageously, the decontamination means is of a material having a circular shape. Hereby, the decontamination means may be a ring, a spiral or a coating. The material may be corundum having embedded therein the oligodynamically active compound. Alternatively, the material can be silver.

BRIEF DESCRIPTION OF THE DRAWINGS

The invention will now be described in more detail, by way of example, with reference to the single FIGURE of the drawings, which shows in longitudinal section an embodiment of the invention.

DETAILED DESCRIPTION OF THE INVENTION

Figure 1:
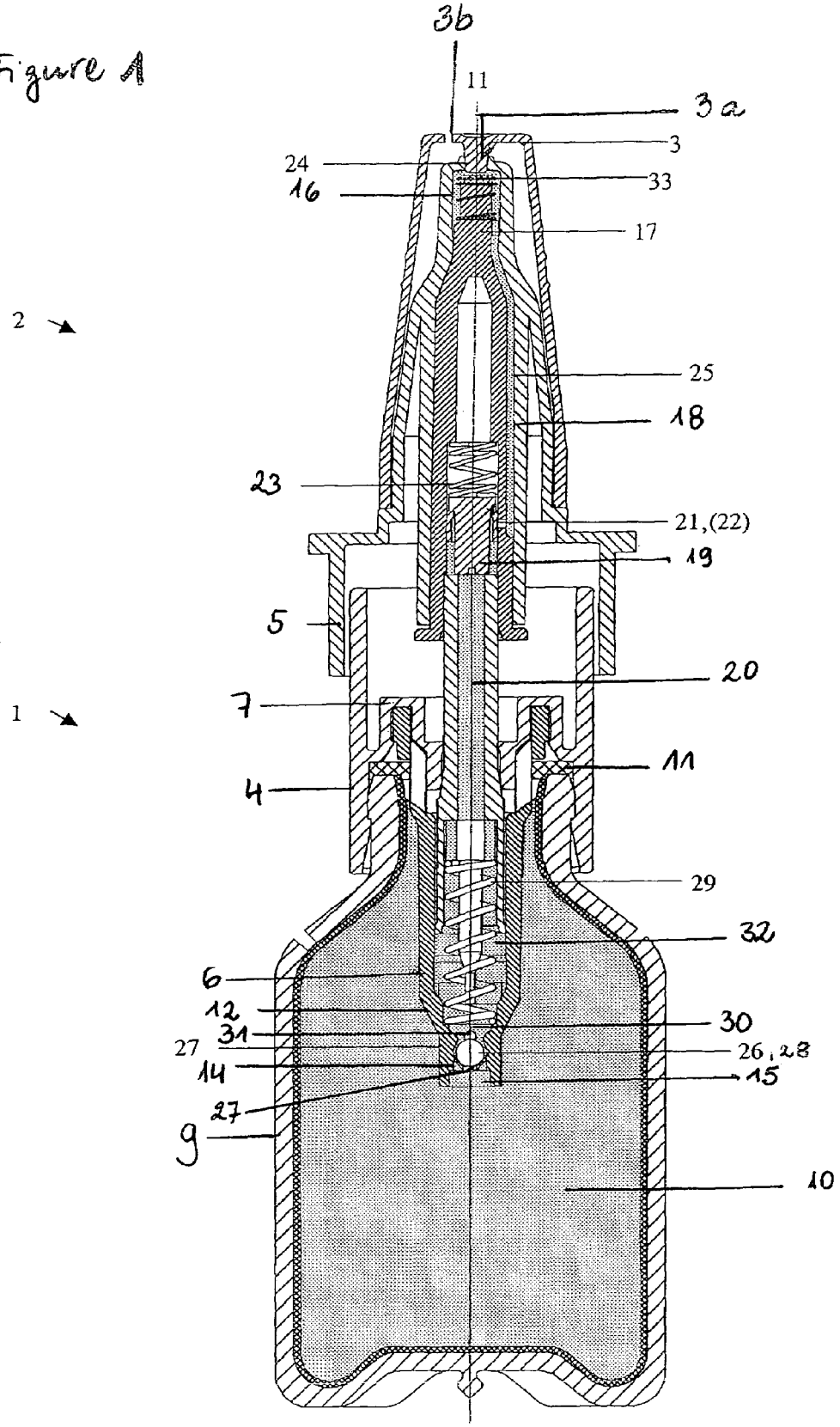

As shown in the FIGURE, the device comprises a metering pump consisting of a cylindrical pump body 1, an operating plunger 2 and a cap 3.

The pump body 1 comprises a first hollow cylindrical body part 4, shown in the drawing as open at the bottom, a second hollow cylindrical body part 5 of bigger diameter (part 5 is part of the operating plunger 2), open at the top in the drawing, and a hollow cylinder 6 that is open at both ends and is fixed centrally on an inwardly directed annular flange 7 in the transition region between the two parts 4,5 of the pump body. The first body part 4 may have an internal screw thread into which a container 9 filled with a germ-free fluid and indicated only generally, can be screwed. As an alternative, instead of the internal screw thread, a snap on closure can be used as shown in the FIGURE. A seal 11 is provided on the underside (in the drawing) of the annular flange 7 to ensure an air-tight seal between the container 9 and the pump body 4. In the neighborhood of the outlet from the first body part 4 of the pump the hollow cylinder 6 has a conically tapered-down transition part 12 that connects with a cylindrical valve section 14 of smaller diameter leading to a rising tube, if available. The open bottom end of the rising tube forms the inlet opening 15 of the metering pump. As an alternative, the rising tube may be omitted, as shown in the Figure.

The operating plunger 2 comprises an outer hollow cylindrical part 17, shown in the drawing as open at the bottom and closed at the top by a head 16, and a hollow inner cylindrical part 18 extending centrally downwards from the head 16. The diameter of the hollow outer cylindrical part 17 is smaller than that of the first pump body part 4.

A piston 19 that fits inside the hollow cylinder 6 and has a through bore 20 is fixed at its top end in the inner hollow cylinder part 18. A piston valve 21 of an outlet valve 22 that fits inside the hollow cylindrical part 18 is supported between the end part of the piston 19 at one end and at the other end on the head 16 via a spring 23. An outlet passage 25 leading to a delivery opening 24 on the head 16 is connected to the interior of the inner hollow cylindrical part 18 at the level of the piston valve 21.

In the upper part of the outlet passage 25 or preferably in the upper part of the outer hollow cylindrical part 17 a decontamination means 33 is provided which comprises a material capable of interacting via an an oligodynamically active substance selected from the group consisting of silver, silver salts, other silver compounds and alloys thereof or nanomers in either metallic or salt form or chemical compounds thereof close to the surface thereof. The decontamination means 33 may hereby be provided at the inner and/or the outer wall of the outlet passage 25.

Silver exhibits the most favourable therapeutically index in terms of concentration in parts per billion. Depending on economical considerations, the means can be made of silver, of another metal coated with silver or of a material having embedded therein the oligodynamically germicidally active substance. In a preferred embodiment of the invention, the means decontamination 33 has a circular shape such as a ring or a spiral. It has been shown that corundum can be one of the convenient materials, when the oligodynamically active substance is embedded in a carrier material.

Depending on the construction of the fluid dispenser and its intended use, the decontamination means 33 can be also provided as a coating. As an example, the coating can be disposed on the outer hollow cylindrical part 17 in the upper part of the outlet passage 25. It is possible to provide a coating made of silver or a coating of a suitable material having embedded therein silver or a silver compound.

It has been shown that in the case of using a coating in the upper part of the outlet passage 25, the silver coating may be suitably a nanocoating comprised of nanomeres. For example, a desired nanocoating comprising silver colloids is described in DE 01 128 625 A1.

As already explained the piston valve 21 which functions as outlet valve is not located directly at the delivery opening 24. Instead the piston valve 21 is located in the inner hollow cylindrical part 18 and an outlet passage 25 is provided leading from the piston valve 21 to the delivery opening 24. The through bore 20 and the outlet passage 25 are thereby separated by the piston valve 21. The function of the piston valve 21 is hereby to allow a delivery of the fluid 10 from the container 9 through the inner space 32, the through bore 20 and the outlet passage 25 to the delivery opening 24 but to prevent a flowing back of the fluid 10 from the outlet passage 25 to the through bore 20.

With the piston valve 21 a closed system is established, i.e. a system into which no fluid flows back once the fluid 10 has left the system. Thereby, the intrusion of germs and bacteria into the closed system is effectively prevented. This results in the possibility to use any suitable material for the components within the closed system as the necessity of using materials capable of interacting with germs or oligodynamically active substances is not present due to the fact that the intrusion of germs is prevented. However, it might be advantageous to use materials which are able to interact with germs by stopping or slowing down their growth or even to use oligodynamically active substances.

The outlet passage 25 is provided as a very thin and small capillary thereby reducing the dead volume, i.e. the volume of the fluid outside the closed system and coming into contact with the decontamination means.

According to embodiments of the invention it is possible to provide antimicrobial coatings on parts of the inlet valve 26 and on parts of the pump housing. Said coatings may be applied directly to plastic elements and steel components of the pump.

An inlet valve 26 comprising a ball 28 cooperating with a valve seat 27 is formed in the valve part 14. A spring 29 fixed to the piston 19 is supported on a projection 30 on the valve part 14 and supports the pumping action. The space inside the hollow cylinder 6 between the piston 19 and the valve part 14 is indicated by the reference numeral 32.

The valve ball 28 can comprise a material capable of interacting with germs eventually even via an oligodynamically active substance. In addition the valve seat 27 and the inner side of the inner hollow cylinder part 18 in the region of the piston valve 21 may be coated with a material capable of interacting with germs eventually even via an oligodynamically active substance. The piston valve 21 can be made of any inert material such as plastic.

The spring means 29 may also comprise a material capable of interacting with germs eventually even via an oligodynamically active substance. In principle, any suitable material may be used, as long as the material is compatible with the formulation.

It has been shown that a preferred material for the above device components is a stainless steel. Generally, a stainless steel contains relatively high amounts of alloy elements such as chromium, nickel, molybdenium, copper, tungsten, aluminium, tantal, niob and titanium, while iron being the remainder representing the major part of the alloy.

It is known that stainless steels are corrosion-resistent. The corrosion resistance is due to an extremely thin and very tough chromium oxide layer on the surface of the steel. Chromium as well as other heavy metals in very small amounts can act as an oligodynamically active substance which may also reduce microbial growth. For example, useful stainless steel materials include such as materials 1.4034 and 1.4401. In various embodiments of the invention, an effective killing of germs may be achieved when a suitable steel such as stainless steel chromium is used as an oligodynamically active substance for the spiral 29 and the inlet valve 26. As the upper spring 23 does not come into contact with the fluid to be filled, the upper spring 23 may be made of a stainless steel material.

From the viewpoint of compatibility of the stainless steels, especially under consideration of possible allergic reactions, a nickel-free stainless steel or a stainless steel comprising very low amounts of nickel should be used.

It is to be noted, that within the closed system particularly for the inlet valve 26, the ball 28, the valve seat 27, the inner part of the hollow cylindrical part 18, the spring means 19 and for every part of the fluid dispenser that comes into contact with the fluid 10, any material capable of interacting with germs can be used such as silver, silver salts, other silver compounds, stainless steel and nanomers thereof in either metallic or salt form or as a chemical compound thereof or plastic.

On the other hand, the material and elements used in the closed system can be free of any oligodynamically active substances.

The metering pump of the invention operates without air pressure compensation, that is to say, no pressure compensation takes place in the container 9 through the inflow of air during its operation. Thereby the intrusion of germs or bacteria into the container 9 or the closed system over the air is prevented.

The metering pump of the invention operates as follows: when the user removes the cap 3 and depresses the operating plunger 2 so as to push it into the second pump body part 5 a corresponding movement of the piston 19 against the force of the spring 29 simultaneously takes place. This presses the ball 28 harder against the valve seat 27 and applies pressure to the liquid 10 that has been sucked into the inner space 32 and the through bore 20 during the previous operation of the metering pump. This pressure displaces the piston valve 21 of the outlet valve 22 against the force of the spring 23, so that the connection to the outlet passage 25 is opened and a precisely measured quantity of the liquid 10 is delivered through the delivery opening 24. As soon as the piston 19 reaches its dead centre position, the pressure in the inner space 32 and in the through bore 20 drops so far that the outlet valve 22 closes and the inlet valve 26 opens, so that liquid 10 is sucked out of the container 9. The inlet valve 26 then closes again. Thereupon the user replaces the cap 3 on the plunger 2 and thereby closes the delivery opening 24.

Liquid remaining at the delivery opening 24, in the outlet passage 25, and in the through bore 20, as well as in the inner space 32 and in the inlet valve 29, come into contact with the various locations where the oligodynamically germicidally substances are in contact with the fluid.

The container 9 filled with a germ-free fluid may be made of a flexible material such as a plastic material. In some cases depending on the final use of the device, the container 9 may be composed of an at least two bag system comprising an external part and an internal bag as the main reservoir for the germ-free fluid.

In a preferred embodiment the container 9 consists of an outer container and of an inner container containing the fluid 10. The inner container is made of a flexible material and with every operation of the metering pump the inner flexible container contracts in order to compensate the pressure within the flexible container when the fluid 10 is sucked out. Thereby a pressure compensation within the flexible container is achieved without the inflow of air into the inner flexible container. The outer container preferably is made of an unflexible material in order to allow the user of the fluid dispenser to hold the fluid dispenser properly and to operate the metering pump. Further, with the outer container the inner flexible container can be protected from destruction. In order to allow the inner flexible container to contract during the operation of the metering pump and to avoid a negative pressure between the two containers at least one small opening in the outer container is provided.

With the above explained system an inflow of air into the container is prevented. Further, the inner flexible container contracts, i. e. reduces in volume, with every operation of the metering pump. This results in a constant contact of the fluid 10 with the inlet opening 15 of the metering pump. Thereby, fluid 10 can be delivered through the inlet opening 15 independent of the orientation of the fluid dispenser, i.e. independent of the way the user holds the fluid dispenser. This allows a 360°-application of the fluid dispenser, i.e. an operation of the fluid dispenser in upright, head first or any other position.

In addition, most of the components contained within the container 9, other than the decontamination means 33, and including the operating plunger 2 and pump body 4, may be formed of flexible material such as plastic material due to its recognised cost and manufacturing advantages. For other strength or load bearing components, such as the springs 23, 29, the plastic material should be strong enough to maintain spring integrity throughout the lifetime of use of the container 9. Further, in the case of wearable components such as the valve ball 28, inlet valve 26, and outlet valve 22, the plastic material should be a wear resistant plastic material. Also, as stated above, the decontamination means 33 may be formed of plastic material coated with the oligodynamically active substance.

One embodiment of the present invention provides a fluid dispenser that includes a cap 3 to cover and to seal the delivery opening 23. The cap 3 is provided with a pin 3*a* and a hole 3*b*. The pin 3*a* fits in the delivery opening 24 located in the head 16. The hole 3*b* functions as an aeration means. By passing air through this hole 3*b*, the excess fluid remaining after use is allowed to evaporate, thus giving still more protection against contamination.

The fluid dispenser according to the invention is perfectly for dispensing minute amounts of liquids of any kinds, preferably a liquid pharmaceutical composition. In a preferred embodiment of the invention the fluid dispenser may be used for suspensing liquid pharmaceutical compositions, such as an ophthalmicum or nasalium. Further administrations are fluids applied as medical devices or cosmetics. The fluid dispenser according to the invention may be available in any size depending on the end use.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

Example 1 Microbiological Test: The microbiological safety of the fluid dispenser has been confirmed by the Media Fill Test and the Dye Test. These tests focused on evaluating the tightness of the system and the protection of the opening of the fluid dispenser. The opening of the fluid dispenser was protected from microbiological growth by the design of the area of the opening. It is believed that the geometry and the small diameter of the tip area as well as the length of the capillary tube increases the difficulty for microbes to enter the fluid dispenser. The antimicrobial effect is especially achieved by the location of the outlet valve and the construction of the dead volume at the outlet part, which had been designed to be difficult to reach for microbial contamination. There may be a hole in the covering cap of the fluid dispenser through which humidity evaporates. Additionally, to reduce any residual risk, a silver spiral was positioned directly behind the opening of the fluid dispenser. The metallic silver exerted an oligodynamic effect.

Example 2 In-Use Test: A simulated daily use microbial challenge study to simulate the In-Use application of the fluid dispenser was conducted. The objective was to determine if microbes would be introduced into the fluid dispenser after rugged usage. Microbes which are typically encountered by the consumer were tested by dispensing drops from the fluid dispenser. The drops were also placed at the tip of the fluid dispenser. At the conclusion of the testing period, sterility of the reservoir was conducted. The results of the In-Use study indicated that there was no ingress of the test microorganisms into the reservoir of the fluid dispenser during the simulated daily use of the dispenser.

The invention claimed is:

1. A fluid dispenser for germ-free fluid comprising a through passage connecting an inlet opening for fluid contained in a supply container made of flexible material and a delivery opening for dispensing said fluid and having therein at least one oligodynamically active substance that is in contact with the fluid;

a metering pump operating without air pressure compensation, whereby no pressure compensation takes place in the container through the inflow of air during the operation of said metering pump, said pump having a spring means being in contact with the fluid, an inlet valve for closing said inlet opening, and an outlet valve, and an outlet passage being part of said through passage leading from said outlet valve to the delivery opening, wherein a decontamination means is provided in the upper part of said outlet passage said decontamination means comprising a material capable of interacting with germs via an oligodynamical substance selected from the group consisting of silver, silver salts, other silver compounds, alloys and nanomers thereof in either metallic or salt form or as a chemical compound thereof.

2. The fluid dispenser according to claim 1, wherein the inlet valve and/or the spring means comprise a material capable of interacting with germs.

3. The fluid dispenser according to claim 2, wherein the material is selected from the group consisting of silver, silver salts, other silver compounds, stainless steel and nanomers thereof in either metallic or salt form or as a chemical compound thereof.

4. The fluid dispenser according to claim 3, wherein the stainless steel contains at least one element selected from the group consisting of chromium, nickel, molybdenium, copper, tungsten, aluminium, titanium, niob and tantal, the remainder being iron as the main component.

5. The fluid dispenser according to claim 1, wherein said through passage is constantly filled, at least in the region of said inlet valve with said fluid.

6. The fluid dispenser according to claim 1, wherein said oligodynamically active substance is provided on the inner side of a cap that can be fitted on to said fluid dispenser to cover said delivery opening.

7. The fluid dispenser according to claim 6, wherein the cap is provided with a pin and a hole.

8. The fluid dispenser according to claim 7, wherein the pin fits in the delivery opening located in the head.

9. The fluid dispenser according to claim 2, wherein said inlet valve further includes a valve seat cooperating with the closure member wherein said valve seat is provided with said oligodynamically active substance.

10. The fluid dispenser according to claim 2, wherein said outlet valve further includes a valve seat cooperating with the closure member.

11. The fluid dispenser according to claim 2, wherein said inlet valve is a ball valve and a valve housing cooperating with a closure member of said inlet valve is provided, said valve housing being provided with said material.

12. The fluid dispenser according to claim 1, wherein said outlet valve is a piston valve and a valve housing cooperating with a closure member of said outlet valve.

13. The fluid dispenser according to claim 1, wherein the decontamination means is of a material having a circular shape.

14. The fluid dispenser according to claim 13, wherein the decontamination means is a ring.

15. The fluid dispenser according to claim 13, wherein the decontamination means is a spiral.

16. The fluid dispenser according to claims 1, wherein the decontamination means is a coating.

17. The fluid dispenser according to claim 13, wherein the material is corundum having embedded therein the oligodynamically active compound.

18. The fluid dispenser according to claim 13, wherein the material is silver.

19. Use of a fluid dispenser according to claim 1 for dispensing minute amounts of a liquid in the field of pharmaceutics, cosmetics and medical devices.

20. The use according to claim 19, wherein the liquids are topically applied.

21. The use of claim 20, wherein the liquid is an ophthalmicum or nasalium.

* * * * *